US006553968B2

(12) United States Patent
Boecking

(10) Patent No.: US 6,553,968 B2
(45) Date of Patent: Apr. 29, 2003

(54) PRESSURE-CONTROLLED INJECTOR WITH SERIALLY CONNECTED CONTROL VALVES

(75) Inventor: Friedrich Boecking, Stuttgart (DE)

(73) Assignee: Robert Bosh GmbH, Stuttgart (DE)

( * ) Notice: Subject to any disclaimer, the term of this patent is extended or adjusted under 35 U.S.C. 154(b) by 0 days.

(21) Appl. No.: 10/011,072

(22) Filed: Nov. 8, 2001

(65) Prior Publication Data

US 2002/0079378 A1 Jun. 27, 2002

(30) Foreign Application Priority Data

Nov. 8, 2000 (DE) ..... 100 55 272

(51) Int. Cl.[7] ..... F02M 37/04

(52) U.S. Cl. ..... 123/467; 123/458; 137/625.65

(58) Field of Search ..... 123/446, 506, 123/500, 501, 467, 514; 137/625.65; 251/57, 28; 417/295; 239/585.1

(56) References Cited

U.S. PATENT DOCUMENTS 5,199,855 A * 4/1993 Nakajima et al. ..... 417/295
5,497,806 A * 3/1996 Swank et al. ..... 137/625.65
5,718,264 A * 2/1998 Sturman ..... 137/625.65
5,927,614 A * 7/1999 Touvelle et al. ..... 239/585.1
5,941,215 A * 8/1999 Augustin ..... 123/467
6,079,392 A * 6/2000 Matsuda ..... 123/458
6,129,332 A * 10/2000 Dusterhoft ..... 251/28
6,168,133 B1 * 1/2001 Heinz et al. ..... 251/57

FOREIGN PATENT DOCUMENTS

DE 197 01 879 A1 7/1998

* cited by examiner

*Primary Examiner*—Carl S. Miller
(74) *Attorney, Agent, or Firm*—Michael J. Striker

(57) ABSTRACT

An injector for injecting fuel in a combustion chamber of an internal combustion engine has a housing provided with a housing opening, a control valve body movable in the opening of the housing, a ring chamber which encloses the control valve body, an inlet connectable with a high pressure collecting chamber and opening into the ring chamber, a nozzle inlet arranged so that during the movement of the control valve body the nozzle inlet is connected with the inlet or separated from the latter, and 2/2-way control valves arranged inside the housing in series so that one of the 2/2-way control valves is force-equalized in an open condition.

11 Claims, 1 Drawing Sheet

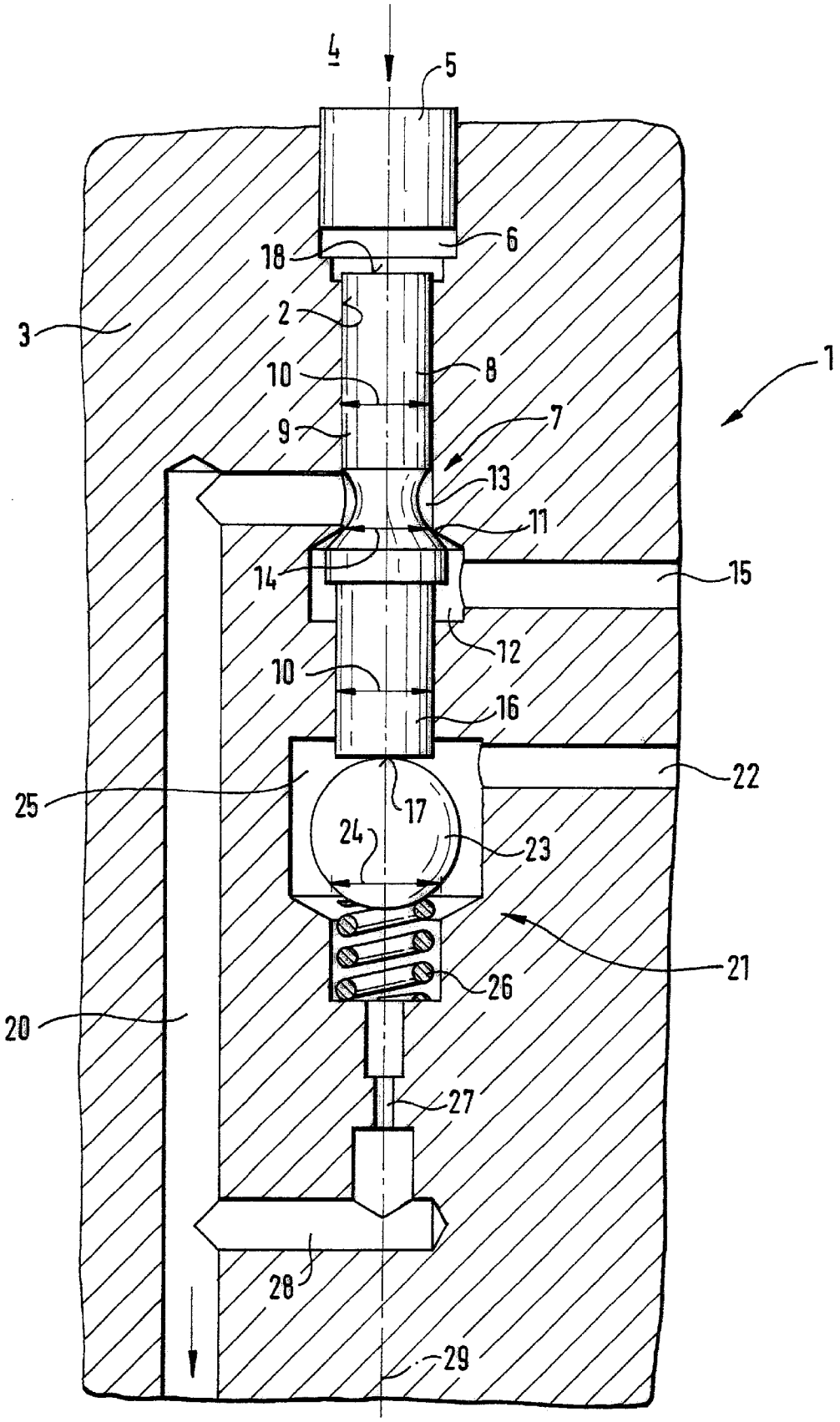
4
5
6
18
2
3
10
8
1
9
7
13
11
14
15
12
10
16
22
25
17
24
23
21
26
20
27
28
29

PRESSURE-CONTROLLED INJECTOR WITH SERIALLY CONNECTED CONTROL VALVES

BACKGROUND OF THE INVENTION

The present invention relates generally to fuel injection systems for internal combustion engines.

More particularly, the present invention relates to a pressure-regulated fuel injector having two, serially connected control valves.

In fuel injection systems with high pressure collecting chambers (common rail), which maintain a high pressure in the system, the initiation of injection and the end of the injection are adjusted with electrically adjustable injectors. The injectors are secured with grip-spring tensioning elements onto the cylinder head of the internal combustion engine, without significant changes to the cylinder head. However, under high pressure, such injectors with a smaller valve wear covering can lead to considerable leakage, which commonly impairs the operation of the injectors.

DE 197 01 879 A1 discloses a fuel injection device for combustion engines which includes a high pressure pump arranged with a high pressure-collecting chamber (common rail) filled with fuel. The high pressure-collecting chamber is connected via an injection line with an injection valve projecting into the combustion chamber of the internal combustion engine. The opening or closing movements are controlled, respectively, by an electrically controlled control valve. The control portion is formed as 3/2-way valve, which is connected with the injection line or a release line to a high-pressure channel flowing to an injection opening of the injection valve. A hydraulic working chamber, or pressure release chamber, fillable with high-pressure fuel, is provided on a control member. The working chamber is controllable through adjustment of the set position of the control member in a release channel.

SUMMARY OF THE INVENTION

It is therefore an object of the present invention to provide a pressure-controlled injector which avoids the disadvantages of the prior art.

More particularly it is an object of the present invention to provide a pressure-controlled injector which avoids the leakage problem noted above.

In keeping with these objects and with others which will become apparent hereinafter, one feature of present invention resides, briefly stated, in a pressure controlled injector which has an injector for injecting fuel in a combustion chamber of an internal combustion engine, comprising a housing provided with a housing opening; a control valve body vertically movable in said opening of said housing; a ring chamber which encloses said control valve body; an inlet connectable with a high pressure collecting chamber and opening into said ring chamber; a nozzle inlet arranged so that during the vertical movement of said control valve body said nozzle inlet is connected with said inlet or separated from the latter; and 2/2-way control valves arranged inside said housing in series so that one of said 2/2-way control valves is force-equalized in an open condition.

The two-way valves (2/2 valves) of the present invention, which are serially connected, allows the upper control valve portion, on which the constant high pressure from the high pressure collecting chamber is based, to be formed in an opened position for regulating or equalizing force, since the valve diameter of the control member of the upper two-way valve corresponds to the guide diameter. Consequently, the two-way control valve which interrupts the high pressure from the high pressure-receiving chamber regulates in a direct way, via a controllable operating unit, such as a piezoregulating unit, which is connected to a hydraulic converter.

A 2/2-way valve, formed as a simple and inexpensive ball valve, is connected on the waste oil side near the force regulating unit of the valve body of the upper 2/2-way valve which interrupts the high pressure from the high pressure collecting chamber, as described above. The ball valve is pressed into its sealing seat when the piezo-regulating unit is controlled and its opening movement opposed. Upon maximum opening of the upper 2/2-way valve, a defined closing of the ball of the lower 2/2-way valve is ensured, so that the disadvantageous results, such as an increase in leakage with small valve wear coverings, are corrected.

Upon closing of the upper 2/2-way valve, the nozzle inlet to the nozzle chamber of the injection nozzle can be released via a ball element of the lower 2/2-way valve, which is disposed in a hollow chamber on the housing side. Based on the fact that the ball body of the lower 2/2-way valve is acted upon with a pressure spring force, the waste oil valve, which operates to counter the piezo element, can close the control valve body of the upper 2/2-way valve (or assist in its closing movement in a vertical direction).

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 illustrates the pressure-controlled injector of the present invention, in a longitudinal cross-sectional view.

DESCRIPTION OF THE PREFERRED EMBODIMENTS

The present invention will now be described with reference to accompanying FIG. 1. The inventive pressure-controlled injector 1, as shown in FIG. 1 has 2/2-way valves which are arranged in series in a housing bore 2. They preferably include an upper 2/2-way control valve 7 and a lower, ball-shaped 2/2-way control valve 21.

The upper 2/2-way control valve 7 is essentially formed as a rotationally symmetrical member, relative to a line of symmetry 29. On the upper side of the 2/2-way control valve body 8 is a first face 18. The 2/2-way control valve body 8 also includes an oppositely disposed second face 17.

Above the upper face 18, a control volume of a hydraulic multiplier 6 is provided, a side of which can be acted upon by pressure of a piston 5. The piston 5, in turn, is acted upon on its side via a controllable piezoregulating unit 4, which is not specifically represented here. Instead of a piezoregulating unit 4, a magnetic valve with a short control time or a mechanical converter for operating the piston 5 could be used to the same effect.

The rotationally symmetrical 2/2-way control valve body 8 includes a constriction 13, or a tapered portion, on which a valve diameter 14 is incorporated. When the 2/2-way control valve body 8 is closed, it lies with its valve diameter 14 on a seating surface 11 provided on the housing side and connects the inlet 15 coming from the high pressure collecting chamber in this manner. In the closed position, a transverse bore 19, as well as the nozzle inlet 20 to the nozzle chamber of an injection nozzle (not specifically represented), are closed off from high pressure.

The inlet 15, which comes from the high pressure collecting chamber, empties in an annular chamber 12 within the housing 3 of the injector 1. The fuel volume coming from the high pressure collecting chamber via the inlet 15 is located in this annular chamber 12 and thereby regulates the high pressure.

The 2/2-way control valve body 8 is supported in the housing 3, specifically in a housing bore. The 2/2-way control valve body 8 includes a first guide portion 9 and a second guide portion 16. By means of both guide portions 9, 16, the control valve body 8 is guided cant- or swing-free in the housing 3 of the injector 1. The force regulating unit of the control valve body 8 in the opened position (that is, upon connection of the nozzle inlet 14 with the transverse bore 19 of the intermediate inlet 20) causes the first and second guide portions 9, 16 of the control valve body 8 to be guided in the same diameter as the valve diameter 14 of the two-way control valve body 8 with the leading or guiding edge 11. Based on these dimensions, the two-way control valve body 8, in the opened state, is operated by the piezoregulating unit 4. The upper two-way control valve 7 is connected on the waste oil side to a ball-shaped two-way valve 21. A ball-shaped closure element 23 lies on the lower face 17 of the two-way control valve body 8. The ball-shaped closure element 23 is surrounded by a hollow chamber 25 in the housing 3 of the injector 1 and is constantly positioned against the lower face 17 of the two-way control valve body 8 by means of a spring element 26. A waste oil line 22 empties into the hollow chamber 25, in which is found the closure element 23 of the ball-shaped two-way valve 21. A throttle element 27 is provided beneath the hollow chamber 25, which is provided with the fuel volume via a shunt 28 from the nozzle inlet 19, 20.

By way of example, if the operating unit 4 is a piezoregulating unit, the piston 5 is then acted upon, and the hydraulic converter (multiplier) 6 causes a pressure increase so that the upper face 18 of the control valve body 8 is impacted with pressure. The control valve body 8 moves downwardly in the housing 3 of the injector 1 so that the valve diameter 14 of the control valve body 8, which is joined to the seating surface 11 in the housing, is returned to its seat and the inlet 15 from the high pressure collecting chamber is opened through the annular chamber 12 to the transverse bore 19 to the nozzle inlet 20. Thereby, pressurized fuel is disposed in the nozzle chamber of the injection nozzle (not represented). The downward, vertical movement of the control valve body 8 in the housing 3 of the injector 1 causes a descent of the lower surface 17 of the control valve body 8 in the lower hollow chamber 25. The ball-shaped closure element 23 of the two-way valve 21 is driven into the lower chamber 25 into its seating against the operation of a pressure spring 26. The valve diameter 24 of the ball-shaped closure element 23 closes the inlet, in which a throttle element 27 is disposed. Up to this point, the nozzle inlet 19, 20 contains high pressure, while the waste oil line 22 is closed off from high pressure through the closure element 23 which is moved to its sealing seat 24.

If the piezoregulating unit is no longer charged, the piston 5 moves upwardly, releasing the hydraulic converter 6, so that the face 18 of the control valve body 8 is driven upwardly. The two-way control valve body 8 moves with its valve diameter 14 in the seating surface 11, guided in its guide portions 9, 16 in the housing 3, and closes the nozzle inlet 19, 20 from the inlet 15 of the high pressure collecting chamber. The residual pressure in the nozzle inlet 19, 20 extends over the shunt 28 (or the throttle element 27) on the sealing seat 24 of the closure element 23 of the lower, ball-shaped two-way control valve. The residual pressure in the shunt 28 and in the transverse bore 19, or the nozzle inlet 20, supports the ascent of the ball-shaped closure element 23 from its sealing seat and, therewith, the closing movement of the upper control valve body 8 in his sealing seat. In this position, the ball-shaped closure element is opened so that the nozzle inlet 20 can be released via the shunt 28. The throttle element 21 can also be released, as well as the housing-side hollow chamber 25 via the waste oil line 22.

Since the ball-shaped closure element 23 is acted upon via the spring element against the operation of the piezoregulating unit 4, the opening movement of the ball-shaped closure element 23 can be facilitated by its support on the lower face 17 of the control valve body 8 which supports the closing movement of the control valve body 8 in its sealing seat 11 in the housing 3.

It will be understood that each of the elements described above, or two or more together, may also find a useful application in other types of constructions differing from the types described above.

While the invention has been illustrated and described herein as a fuel injector with serially connected control valves, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An injector for injecting fuel in a combustion chamber of an internal combustion engine, comprising a housing provided with a housing opening; a control valve body movable in said opening of said housing; a ring chamber which encloses said control valve body; an inlet connectable with a high pressure collecting chamber and opening into said ring chamber; a nozzle inlet arranged so that during the movement of said control valve body said nozzle inlet is connected with said inlet or separated from the latter; and 2/2-way control valves arranged inside said housing in series so that one of said 2/2-way control valves is force-equalized in an open condition, one of said 2/2-way control valves being formed as a ball-shaped control valve and having a closing element; and a spring element which is arranged in a hollow chamber of said housing and adjusts said closing element of said ball-shaped control valve against an end surface of said control valve body.

2. An injector as defined in claim 1, wherein said control valve body has two guide portions with which said control valve body is guided in said opening of said housing.

3. An injector as defined in claim 2, wherein said guide portions of said control valve body have an identical diameter.

4. An injector as defined in claim 3, wherein said control valve body has a seat diameter, said guide portions having a diameter corresponding to said seat diameter.

5. An injector as defined in claim 1; and further comprising a regulating unit provided for said 2/2-way control valves, and a hydraulic convertor associated with said regulating unit.

6. An injector as defined in claim 1, wherein one of said 2/2-way control valves is formed as a ball-shaped control valve and has a closure element; and further comprising a spring element which is arranged in a hollow chamber of said housing and adjusts said closing element of said ball-shaped control valve against an end surface of said control valve body.

7. An injector as defined in claim 1, wherein said nozzle inlet has a branch, said hollow chamber being connected with said branch of said nozzle inlet via a throttle element.

8. An injector as defined in claim 1, wherein one of said 2/2-way valves is a ball-shaped valve and has a closing element which moves in its sealing seat when the other of said 2/2-way control valves is opened.

9. An injector as defined in claim 1, wherein one of said 2/2-way valves is ball-shaped and is moved to its open position when the other of said 2/2-way valves is moved with its seat diameter into a seat surface provided in said housing.

10. An injector for injecting fuel in a combustion chamber of an internal combustion engine, comprising a housing provided with a housing opening; a control valve body movable in said opening of said housing; a ring chamber which encloses said control valve body; an inlet connectable with a high pressure collecting chamber and opening into said ring chamber; a nozzle inlet arranged so that during the movement of said control valve body said nozzle inlet is connected with said inlet or separated from the latter; and 2/2-way control valves arranged inside said housing in series so that one of said 2/2-way control valves is force-equalized in an open condition, one of said 2/2-way valves being a ball-shaped valve and having a closing element which moves in its sealing seat when the other of said 2/2-way control valves is opened.

11. An injector for injecting fuel in a combustion chamber of an internal combustion engine, comprising a housing provided with a housing opening; a control valve body movable in said opening of said housing; a ring chamber which encloses said control valve body; an inlet connectable with a high pressure collecting chamber and opening into said ring chamber; a nozzle inlet arranged so that during the movement of said control valve body said nozzle inlet is connected with said inlet or separated from the latter; and 2/2-way control valves arranged inside said housing in series so that one of said 2/2-way control valves is force-equalized in an open condition, one of said 2/2-way valve being ball-shaped and being moved to its open position when the other of said 2/2-way valve is moved with its seat diameter into a seat surface provided in said housing.

* * * * *